US007532853B2

(12) United States Patent
Shimizu

(10) Patent No.: US 7,532,853 B2
(45) Date of Patent: May 12, 2009

(54) IMAGE FORMING DEVICE

(75) Inventor: Takashi Shimizu, Kakamigahara (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 335 days.

(21) Appl. No.: 11/456,597

(22) Filed: Jul. 11, 2006

(65) Prior Publication Data

US 2007/0008396 A1 Jan. 11, 2007

(30) Foreign Application Priority Data

Jul. 11, 2005 (JP) ..... 2005-202040

(51) Int. Cl.
*G03G 15/00* (2006.01)

(52) U.S. Cl. ..... 399/400; 399/397

(58) Field of Classification Search ..... 399/397, 399/398, 399, 400

See application file for complete search history.

(56) References Cited

U.S. PATENT DOCUMENTS 5,812,920 A * 9/1998 Mizude et al. ..... 399/316

FOREIGN PATENT DOCUMENTS

| | | |
|---|---|---|
| JP | 6-314005 | 11/1994 |
| JP | 2002-328552 | 11/2002 |
| JP | 06314005 | * 11/2006 |

* cited by examiner

*Primary Examiner*—Daniel J Colilla
*Assistant Examiner*—Allister Primo
(74) *Attorney, Agent, or Firm*—Banner & Witcoff, Ltd.

(57) ABSTRACT

An image forming device includes a transfer unit having a photosensitive drum and a transfer roller, a fixing unit including a press roller and a heating roller, and a guide member on a non-image-forming surface side of the recording medium between the transfer and fixing units. At a transfer nip where the transfer roller contacts the drum, a developer image is transferred onto the recording medium. At a fixing nip where the press roller impinges upon the heating roller, the developer image is fixed onto the recording medium. The guide member guides the recording medium into the fixing unit and includes a grounded conductive member and ribs, which control contact of the recording medium with the conductive member by protruding towards the non-image-forming surface of the recording medium. The conductive member and the ribs are formed parallel with a line that connects the transfer nip and the fixing nip.

8 Claims, 3 Drawing Sheets

IMAGE FORMING DEVICE

CROSS REFERENCE TO RELATED APPLICATION

This application claims priority from Japanese Patent Application No. 2005-202040, filed on Jul. 11, 2005, the entire subject matter of which is incorporated herein by reference.

FIELD

Aspects of the present invention relate to an image forming device such as a laser printer whereby a developer image on a photosensitive body drum is transferred to a recording medium (e.g., paper), and the developer image is fixed on the recording paper to form an image.

BACKGROUND

With conventional electrostatic photographic image-forming devices such as laser printers, the photosensitive drum of a transfer unit is uniformly charged, and the surface of the photosensitive drum is then irradiated with a light beam emitted from a light generator including a laser diode or the like, thereby forming an electrostatic latent image, whereupon the electrostatic latent image is visualized using developer. Subsequently, the developer is then transferred onto recording paper passing between a transfer roller and the photosensitive drum of the transfer unit, and the recording paper is then passed between a press roller and a heating roller in a fixing unit to fix the developer image onto the recording paper.

A guide member that guides the recording paper is provided between the fixing unit and transfer unit as described in JP patent application publication no. H6-314005. The guide member attracts the recording paper subsequent to transfer onto the guide member side from the side of the non-image-forming surface by electrostatic adsorption in order to reliably transport the material. The guide member has a grounded conductive member formed from a metal plate or the like across the entire width of the recording paper and resin ribs that protrude in the direction of the non-image-forming surface side of the recording paper from the conductive member. The ribs prevent the generation of a false image resulting from contact of the recording paper with the conductive member.

With the conventional type of device described above, the guide member that is provided in the transport path between the transfer unit and fixing unit is formed so that it is curved upwards and downwards along the direction of transport of a recording medium (e.g., paper).

As a result, the distance between the conductive member and the recording paper that is passing along the transport route between the transport unit and fixing unit is not constant. Consequently, problems have occurred with the generation of false images because the potential differential between the recording paper and the conductive member varies, causing developer loss resulting from leaks or the like. For example, variation in the distance between the recording paper and the conductive member is influenced by differences in recording paper thickness, hardness and stiffness, and is also influenced by differences in recording paper transport rate.

SUMMARY

According to aspects of the invention an image forming device for forming images on recording paper medium is provided, which has a transfer unit whereby recording paper is held at a transfer nip where a transfer roller impinges upon a photosensitive body drum, and a developer image on the photosensitive body drum is transferred onto the recording paper; a fixing unit whereby the recording paper is held at a fixing nip where a press roll impinges upon a heating roll, thereby fixing the developer image on the recording paper; and a guide member that is provided on the non-image-forming surface side of the recording paper between the transfer unit and the fixing unit, and guides, into the fixing unit, the recording paper on which the developer image has been transferred by the transfer unit, the image forming device characterized in that the guide member has a grounded conductive member and ribs that control contact of the recording paper with the conductive member by protruding towards the non-image-forming surface of the recording paper, where the conductive member and the ribs are formed parallel with a line that connects the exit opening of the transfer nip and the entry opening of the fixing nip. The device may include a transfer unit including a photosensitive drum and a transfer roller, wherein a recording medium is held at a transfer nip where the transfer roller impinges upon the photosensitive drum and a developer image on the photosensitive drum is transferred onto the recording medium. Also, the device may include a fixing unit including a press roller and a heating roller, wherein the recording medium is held at a fixing nip where the press roller impinges upon the heating roller to fix the developer image on the recording medium; and a guide member provided on a non-image-forming surface side of the recording medium between the transfer unit and the fixing unit. The guide member may be configured to guide the recording medium into the fixing unit, wherein the guide member includes a grounded conductive member and ribs, the ribs configured to control contact of the recording medium with the conductive member by protruding towards the non-image-forming surface of the recording medium, and wherein the conductive member and the ribs are formed parallel with a line that connects the transfer nip and the fixing nip.

DETAILED DESCRIPTION

Figure 1:
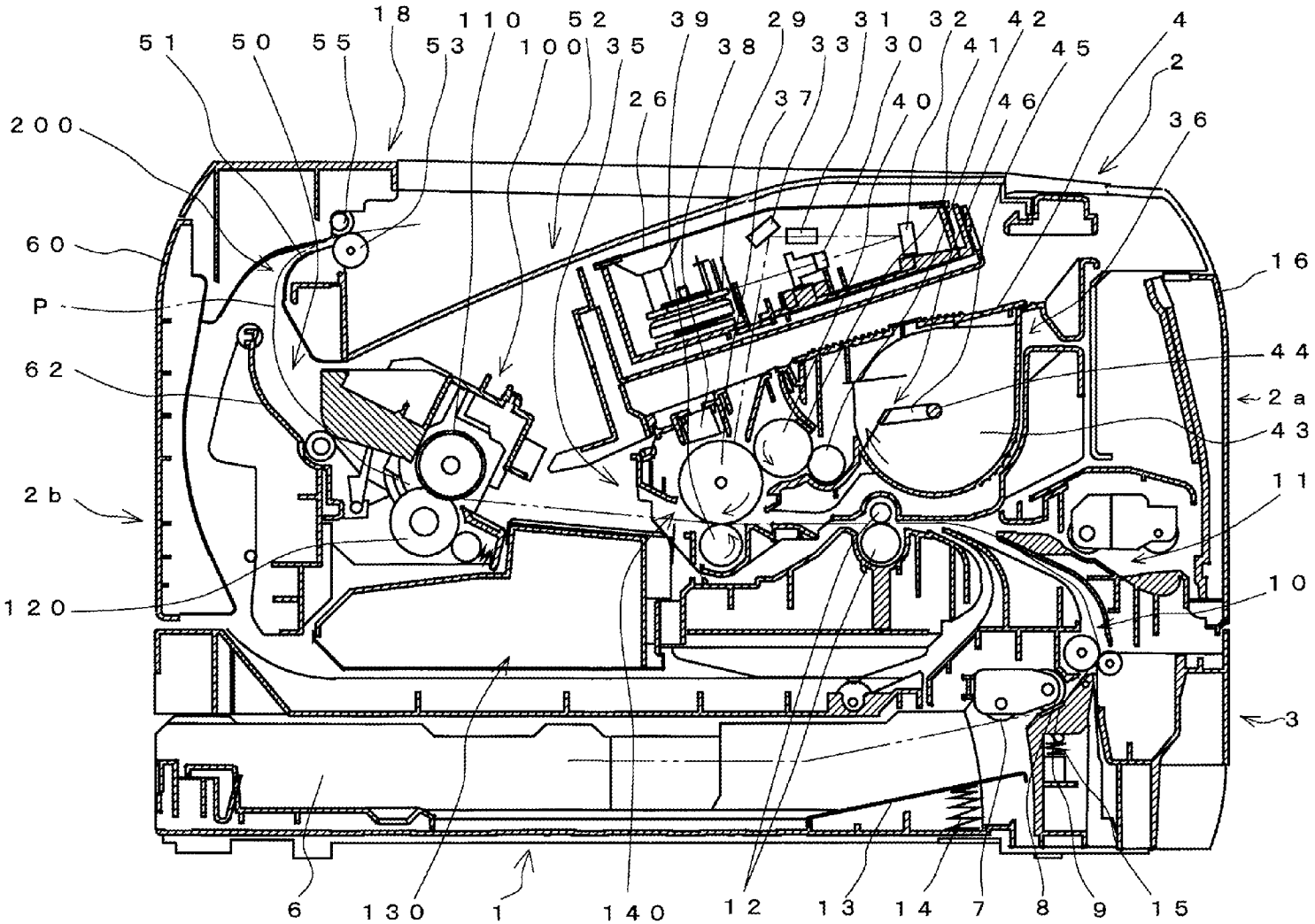
FIG. 1 depicts a schematic of a side cross-section of a laser printer according to at least one aspect of the present invention.

FIG. 1 is a schematic side cross-section of a laser printer 1 used as an example of an image forming device according to aspect of the present invention. The laser printer 1 has a case 2 with a top cover 18 that serves as the top surface and four side surfaces such as front surface 2*a* or back surface 2*b* (partially shown), where the top cover 18 forms a paper exit tray 52 as a depression in the case 2. At the bottom of the case 2, a feed cassette 6 that can feed multiple sheets of recording paper is provided so that it can be inserted and retracted from the front surface 2*a* of the case 2. A pull-out tray 11 in which the sheets of recording paper are placed is provided in the front surface 2*a*, and an opening and closing front cover 16 is also provided.

The laser printer 1 has a feeder 3 for feeding recording paper (where the transport path of the recording paper is represented by a virtual line P), a process unit 4 used as the image forming part in which a visible developer image is formed on the recording paper that has been fed, a fixing unit 100 that fixes the developer image that has been formed onto the recording paper and a paper exit part 200 for receiving the recording paper that has passed through the fixing unit 100, which are present in a case 2 having a top cover 18, front cover 16, and rear cover 60 provided on the back surface 2*b*. The front and back surfaces are perpendicular to the axis of rotation of the fixing roller (described below) present in the fixing unit 100. The surface on the side closest to the fixing unit 100 (left surface in FIG. 1) is taken as the back surface 2*b*, and the opposite side is taken as the front surface 2*a*.

The feeder 3 includes a paper feed cassette 6, paper feed rollers 7 and 8 provided above the recording paper at the end on the side of the leading edge in the transport direction (front surface side) of the recording paper stacked in the feed cassette 6, and a paper feed pad 9. In the paper feeder 3 is formed a paper feed path 10 which is the recording paper transport path whereby the recording paper that has been fed from the paper feed cassette 6 is inverted and transported towards the bottom of the process unit 4, and a resist roller pair 12 that sits in the paper path 10 is provided in the paper feeder 3. In addition to the recording paper in the paper feed cassette 6, recording paper that has been manually placed in a manual tray 11 is also fed into the paper feed path 10, but in either case, after being temporarily stopped at the resist roller pair 12, the paper is supplied to the process unit 4 in accordance with the timing of image formation in the process unit 4.

The paper feed cassette 6 is disposed at the bottom of the fixing unit 100 and process unit 4 so that it can be inserted and retracted with respect to the front surface 2*a* of the case 2. A paper pressure plate 13 and spring 14 are provided in the paper feed cassette 6. The paper pressure plate 13 allows the recording paper to be stacked in a stack. Also, the paper pressure plate 13 is supported so that it can pivot at the end that is farthest from the paper feed roller 7 and it can move upwards and downwards at the near end. In addition, a spring 14 is provided to push the back surface of the paper pressure plate 13 on the side nearest the paper feed roller 7 in an upward direction. As a result, the paper press plate 13 swings downwards in opposition to the force of the spring 14 as the stacked amount of recording paper increases, with the end farthest from the paper feed roller 7 like as a support point.

The paper feed roller 8 and paper feed pad 9 are situated opposite each other, so that the paper feed pad 9 is pressed in the direction of the paper feed roller 8 by a spring 15 that is provided on the back surface of the paper feed pad 9. The recording paper that is at the top-most position in the stack on the paper press plate 13 is thereby pressed so that it impinges upon the paper feed roller 7 by the spring 14 from the back side of the paper press plate 13, and the top-most recording paper is thereby fed by the paper feed roller 7 and is held between the paper feed roller 8 and paper feed pad 9. As a result of rotation of the paper feed roller 8, the paper is separated into single sheets by the paper feed roller 8 and paper feed pad 9 and is fed in the direction of the paper feed path 10.

The recording paper that has been manually fed and supplied from the manual tray 11 or from the paper feed cassette 6 is transported to the resist roller pair 12 situated above the paper feed roller 7 and other parts. After the supplied recording paper is held at the resist roller pair 12, it transported to the process unit 4.

The scanning unit 26 present in the upper part of the process unit 4 has a laser light generator (not shown), a polygonal mirror 29 that is rotationally driven at high speed, a first scanning lens (fθ lens) 30, a second scanning lens (cylindrical lens) 31, and reflex mirrors 32 and 33. The light beam that is modulated based on the image data that is emitted from the laser light emitter, as indicated by the dotted line, passes from the polygonal mirror 29, to the first scanning lens 30, to the reflex mirror 32, to the second scanning lens 31, and passes through the reflex mirror 33, or is reflected. The surface of the photosensitive drum 37 in the process unit 4 is thereby scanned and exposed.

The process unit 4 includes a drum unit 35 and development unit 36. A photosensitive drum 37, charger 38, transfer roller 39 and other such components are present in the drum unit 35. The development unit 36 is installed so that it can be freely attached and removed with respect to the drum unit 35, and has components such as a development roller 40, a thickness control blade 41, a supply roller 42, and a hopper 43.

The developer in the hopper 43 is mixed in the direction indicated by the arrow due to rotation of the agitator 45 supported by a rotational shaft 44, and the developer is discharged from the supply opening 46 that opens onto the hopper 43. The supply roller 42 is situated rotatably at a location to the side of the supply opening 46. In addition, a development roller 40 is rotatably situated opposite the supply roller 42. The supply roller 42 and development roller 40 impinge upon each other in a condition whereby there is a certain degree of compression.

The development roller 40 is produced by coating a metal roller shaft with a roller composed of conductive rubber material, and is rotatably driven in the direction indicated by the arrow (counter-clockwise direction). The device has a configuration whereby a development bias is applied to the development roller 40. In addition, a thickness control blade 41 is disposed in the vicinity of the development roller 40. This thickness control blade 41 is configured so that a press part with a semicircular cross section composed of insulating silicone rubber is provided at the tip of the blade main body composed of metal plate spring material, and is supported on the development unit 36 near the developing roller 40 so that it presses at the top of the development roller 40 due to the elastic force of the blade body.

The developer that is discharged from the supply opening 46 is supplied to the development roller 40 due to rotation of the supply roller 42, and, at this time, positive abrasive charging occurs between the supply roller 42 and development roller 40. In addition, the developer that has been supplied to the development roller 40 advances between the development roller 40 and the press part of the thickness control blade 41 along with rotation of the development roller 40, and is thus held on the development roller 40 as a thin layer of uniform thickness.

The photosensitive drum 37 is supported so that it can rotate in the direction indicated by the arrow (clockwise direction) in the drum unit 35 in a configuration opposite to the development roller 40. This photosensitive drum 37 is grounded by the drum main body, and the surface thereof is formed by a positive-charging photosensitive layer composed of polycarbonate or the like.

The charger 38 is oppositely disposed above and left of the photosensitive drum 37 with a prescribed gap. The charger 38 is a cyclotron-type charger used for positive charging which generates a corona discharge from a charging wire such as tungsten, and is configured so that it produces a uniform positive charge at the surface of the photosensitive drum 37.

The transfer roller 39 is situated opposite the photosensitive drum 37 below the photosensitive drum 37, and is supported rotatably on the drum unit 35 so that it can rotate in the direction indicated by the arrow (counter-clockwise direction). The transfer roller 39 is formed by coating a metal roller shaft with a roller composed of conductive rubber material, and is configured so that a transfer bias is applied during transfer. The transfer unit 140 includes a photosensitive drum 37 and a transfer roller 39.

Figure 2:
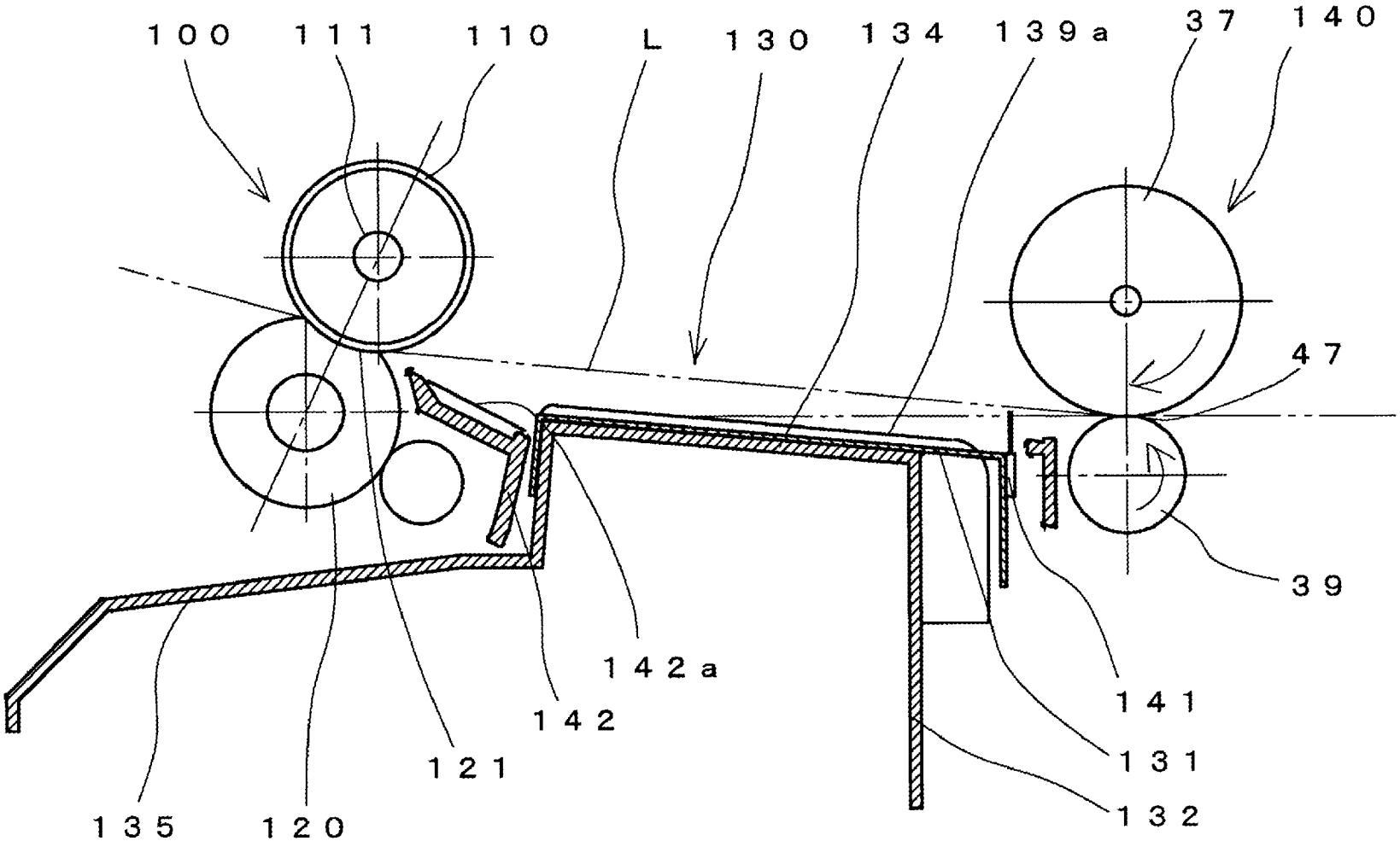
FIG. 2 shows an enlarged view of the transfer unit and fixing unit according to at least one aspect of the invention.

FIG. 2 is an enlarged view of the transfer unit 140 and fixing unit 100. As shown in FIG. 2, when the transfer roller 39 is made to impinge upon the photosensitive drum 37, the rubber material of the transfer roller 39 is elastically deformed, thereby forming a transfer nip 47 at the site of contact between the photosensitive drum 37 and transfer roller 39. In addition, according to this aspect, the rotational center of the photosensitive drum 37 and the rotational center of the transfer roller 39 are disposed along a vertical line.

The surface of the photosensitive drum 37 is charged positively and uniformly by the charger 38 as the photosensitive drum 37 rotates. Next, an electrostatic latent image is formed by development using the laser beam from the scanning unit 26.

Subsequently, by a developing bias applied to the developing roller 40 at the time when the developing roller 40 is opposite the photosensitive drum 37, the developer that has been positively charged and held on the development roller 40 is supplied to the electrostatic latent image that is formed on the surface of the photosensitive drum 37. That is, the exposed regions that have decreased potential resulting from exposure by the laser beam on the surface of the photosensitive drum 37 that has been uniformly positively charged. As a result, the developer is selectively retained and the developer image is formed (transfer image).

Subsequently, the developer image that has been retained at the surface of the photosensitive drum 37 is transferred to the recording paper when the recording paper is trapped at the transfer nip 47, specifically, when the paper is trapped between the photosensitive drum 37 and transfer roller 39, and a transfer bias is applied to the transfer roller 39 during the time that the recording paper passes through the transfer nip 47.

The fixing unit 100 is disposed downstream in the direction of recording paper transport from the process unit 4 above the paper feed cassette 6 towards the process unit 4. The fixing unit 100 has a heating roller 110 with a heater 111; along with a press roller 120 provided opposite the heating roller 110 which presses against the surface of the heating roller 110. The heating roller 110 is a metal cylinder with open ends, and a heater 111 including, for example, a halogen lamp is housed therein so that a configuration results whereby the roller is heated by the heater 111.

The press roller 120 has a PTFE (polytetrafluoroethylene) film enclosing the surface of an elastic body such as silicone rubber, and the press roller 120 is in a condition whereby it presses the heating roller 110, and drives the heating roller 110 to rotate. As shown in FIG. 2, when the press roller 120 is made to impinge upon the heating roller 110, the elastic body of the press roller 120 elastically deforms to form a fixing nip 121 at the site of contact between the heating roller 110 and press roller 120. When the rate of transport of the recording paper is high, it is preferable for the fixing nip 121 to be longer. Specifically, more reliable heating and fixing can occur when the length of contact of the heating roller 110 and press roller 120 increases.

In addition, according to one aspect, the line joining the rotational center of the heating roller 110 and the rotational center of the press roller 120 is at an incline with respect to the vertical line connecting the rotational center of the photosensitive drum 37 and the rotational center of the transfer roller 39. In addition, the heating roller 120 is situated to the downstream side in the direction of recording paper transport from the heating roller 110 and is disposed so that the direction of recording paper transport is inclined upwards from the fixing unit 100.

The developer image which is a visible image that has been transferred onto the recording paper in the process unit 4 is thermally fixed in the fixing unit 100 during the time when the recording paper is held in the fixing nip 121, specifically, between the heating roller 110 and press roller 120 as the recording paper passes through the fixing nip 121. Subsequently, the recording paper is sent to the paper exit path 50 which is the recording paper transport path formed in the paper exit part 200.

The paper exit part 200 includes an inner guide member 51 and outer guide member 62 that constitute the paper exit path 50. The paper exit roller pair provided at the exit opening where the recording paper exits onto the paper exit tray 52 provided in the top cover 18 includes a bottom paper exit roller 53 and top paper exit roller 55.

The paper exit tray 52 provides a flat plate that is approximately rectangular to the eye, where the back end is recessed into the case 2, thereby forming a depression and producing a configuration which is inclined gradually upwards from the back surface end to the front surface. The recording paper that has been transported through the fixing unit 100 to the paper exit path 50 is turned around so that the direction of paper transport is reversed upwards by the inner guide member 51 and outer guide member 62. The paper is thus sent to the paper exit rollers 53, 55, where the paper is discharged towards the front surface of the paper exit tray 52 via the paper exit rollers 53, 55.

Figure 3:
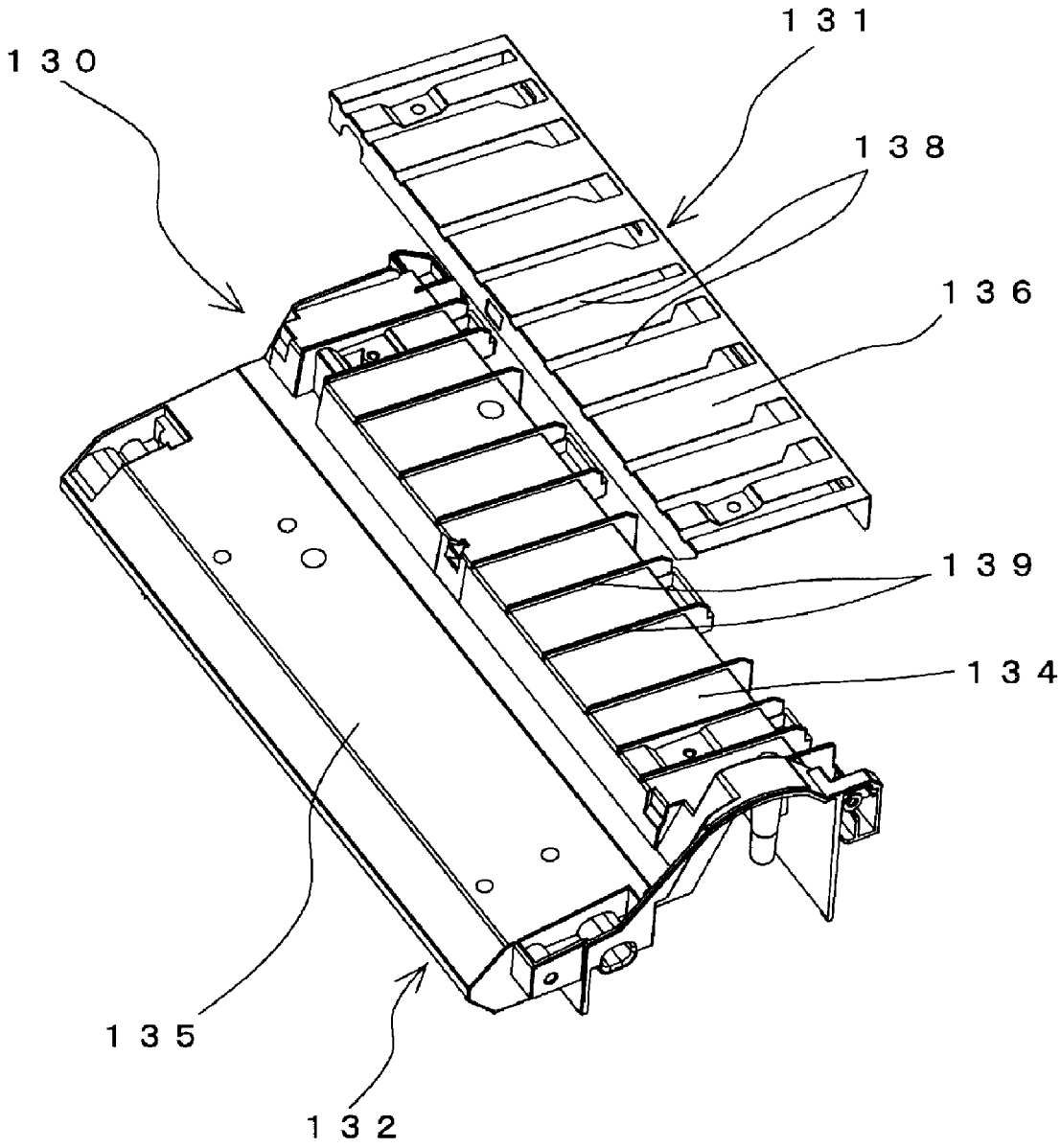
FIG. 3 shows an exploded perspective view of a guide member according to at least one aspect of the present invention.

A guide member 130 is provided between the transfer unit 140 and the fixing unit 100. The guide member 130, as shown in the exploded perspective view of the guide member 130 in FIG. 3, has a conductive member 131 press-formed from metal sheet and a guide frame 132 made from synthetic resin. The guide frame 132 is made of an insulating material, and a table 134 inserted between the transfer unit 140 and fixing unit 100 is formed on the guide frame 132. A slope 135 that extends from the table 134 underneath the press roller 120 is also formed.

The conductive member 131 is grounded, and the conductive member 131 and guide frame 132 are formed at a width in accordance with the width of the recording paper. A flat part 136 is formed in the conductive member 131 so that it covers the table 134 of the guide frame 132. Multiple slits 138 are formed in the flat part 136 in the conductive member 131 along the direction of transport of the recording paper. Ribs 139 are inserted through the slits 138 so that they protrude into the table 134 of the guide frame 132. The ribs 139 are formed to extend from the flat part 136.

The top surface **139*a* of the rib 139, as shown in FIG. 2, is formed parallel with a straight line L that connects the entry opening of the fixing nip 121 between the heating roller 110 and press roller 120 and the exit opening of the transfer nip 47 between the photosensitive drum 37 and the transfer roller 39. Specifically, the top surfaces 139*a* of the ribs 139 opposite the non-image-forming surface of the recording paper are formed parallel with the straight line L that connects the exit opening of the transfer nip 47 and the entrance opening of the fixing nip 121. In addition, the table 134 also is formed parallel with the straight line L that connects the exit opening of the transfer nip 47 and the entrance opening of the fixing nip 121. A configuration is thus produced in which the flat part 136 of the conductive member 131 is also parallel with the straight line L connecting the exit opening of the transfer nip 47 and the entrance opening of the fixing nip 121. The top surface 139***a* of the rib 139 is also parallel with the flat part 136.

The ribs 139 are provided along the widthwise direction of the recording paper so that they are all parallel, and the top surfaces 139*a* of the ribs 139 are formed so that they are lower than the straight line L connecting the exit opening of the transfer nip 47 and the entrance opening of the fixing nip 121, specifically, so that they are on the non-image-forming surface of the recording paper. In addition, the height from the conductive member 131 to the top surfaces 139*a* of the ribs 139 is made so that the recording paper does not touch the conductive member 131 by sagging down between the ribs 139 to the conductive member 131 when the recording paper is in contact with the top surfaces 139*a* of the ribs 139.

The straight line that connects the entrance opening of the fixing nip 121 and the exit opening of the transfer nip 47 is at an incline, and the entrance opening of the fixing nip 121 is situated at a location that is higher than the exit opening of the transfer nip 47. Consequently, the top surfaces 139*a* of the ribs 139 and the flat part 136 of the conductive member 131 are inclined.

In this aspect, a configuration is produced in which the direction of transport of the recording paper from the transfer nip 47 is in a nearly horizontal orientation, and so that the direction of transport of the recording paper intersects with the top surfaces 139*a* of the ribs 139 of the guide member 130. Thus, the leading edge of the recording paper that passes through the transfer nip 47 contacts the top surfaces 139*a* of the ribs 139.

A discharging brush 141 is provided between the transfer unit 140 and guide member 130, and an auxiliary guide member 142 is provided between the guide member 130 and fixing unit 100. The auxiliary guide member 142 is situated between the table 134 of the guide frame 132 and the press roller 120, and a guide surface 142*a* is formed on the auxiliary guide member 142 that is opposite the non-image-forming surface of the recording paper.

The auxiliary guide member 142 is formed from an insulating material such as synthetic resin or the like. The guide surface 142*a* is formed so that it extends from near the downstream end of the top surfaces 139*a* of the ribs 139 to near the entrance opening of the fixing nip 121. The end of the guide surface 142*a* nearest the guide member 130, according to one aspect, is disposed underneath at a location whereby it is farther from the recording paper than the top surfaces 139*a* of the ribs 139. The guide surface 142*a* is disposed at more of an incline than the top surfaces 139*a* of the ribs 139 with respect to the direction of transport of the recording paper, so that the entrance opening of the fixing nip 121 is situated above the extension of the guide surface 142*a*.

Next, a description will be presented regarding the operation of the laser printer 1 according to some aspects.

First, the topmost sheet of recording paper in the paper feed cassette 6 is fed by the paper feed roller 7 and held between the paper feed roller 8 and paper feed pad 9, whereupon the recording paper is fed in the direction of the paper feed path 10. The recording paper passes through the paper feed path 10, and is stopped at the temporary resist roller pair 12, before being supplied to the image forming part of the process unit 4 in accordance with the timing of image formation.

The surface of the photosensitive drum 37 is charged positively and uniformly by the charger 38, and an electrostatic latent image is formed by exposure with a laser beam from the scanning unit 26. Subsequently, a developer image is formed by contact of the developer with the surface of the photosensitive drum 37, and is transferred to the recording paper during the period when the recording paper passes through the transfer nip 47 between the photosensitive drum 37 and transfer roller 39. The recording paper is then thermally fixed as it passes through the fixing nip 121 between the press roller 120 and the heating roller 110 of the fixing unit 100. The recording paper then is discharged over the paper exit tray 52 through the paper exit path 50.

The recording paper is guided by the guide member 130 through the transfer unit 140, and, upon reaching the fixing unit 100, the recording paper that has passed through the exit opening of the transfer nip 47 is sent in the direction of recording paper transport by the transfer unit 140. In one aspect, the leading edge of the recording paper that has been discharged in a nearly horizontal orientation comes into contact with the top surfaces 139*a* of the ribs 139 of the guide member 130, and the leading edge of the recording paper is thus sent out across the top surface 139*a*.

The front edge of the discharged recording paper then moves to the guide surface 142*a* of the auxiliary guide member 142 from the top surfaces 139*a*, and is sent along the guide surface 142*a*, and reaches the entry opening of the fixing nip 121 by being guided by the guide surface 142*a*. At this time, the end of the guide surface 142*a* nearest the guide member 130 is situated farther from the recording paper than the top surfaces 139*a*, and so the recording paper is smoothly guided without getting caught on the end of the guide surface 142*a*.

Thus, the leading edge of the recording paper is caught between the heating roller 110 and press roller 120, and passes through the fixing nip 121. When the recording paper is caught by the transfer nip 47 and fixing nip 121, the recording paper is nearly as straight as the straight line connecting the exit opening of the transfer nip 47 and the entrance opening of the fixing nip 121. When the transport speed of the recording paper in the transfer unit 140 and the fixing unit 100 are the same, the recording paper is sent while remaining nearly as straight as the straight line L connecting the exit opening of the transfer nip 47 and the entrance opening of the fixing nip 121.

At this time, the distance between the recording paper and the conductive member 131 is nearly constant in each location, and the potential difference between the recording paper and the conductive member 131 becomes constant at each location, so that generation of leaks or other effects due to variation in potential differential can be prevented, thereby preventing the generation of anomalous images. Moreover, because the straight line L connecting the entrance opening of the fixing nip 121 and the exit opening of the transfer nip 47 is parallel to the ribs 139, prior to arrival of the front edge of the recording paper at the fixing nip 121, it is possible to provide a uniform separation between the recording paper and the conductive member 131, thereby maintaining uniform potential differential between the recording paper and the conductive member 131 and stabilizing transport.

When the recording paper is thick, the front edge of the recording paper similarly contacts the top surfaces 139*a*, and is sent out along the top surfaces 139*a* to be guided by the guide surface 142*a* of the auxiliary guide member 142. It is then conducted into the fixing nip 121, and is discharged after passing through the fixing nip 121. At this time, the recording paper is discharged while maintaining it in nearly the same orientation as the straight line L connecting the exit opening of the transfer nip 47 and the entrance opening of the fixing nip 121. The distance between the recording paper and the conductive member 131 is thus nearly constant at each location, and the potential differential between the recording paper and the conductive member 131 is thus nearly constant at each location.

When the transport rate is slow, the leading edge of the recording paper contacts the top surfaces 139*a* nearest the transfer unit 140 when it contacts the top surfaces 139*a* of the ribs 139. When the transport rate is high, there are cases where the leading edge contacts the top surfaces 139*a* near the fixing unit 100 when it contacts the top surfaces 139*a* of the ribs 139. Whether the transport rate is slow or fast, the paper is discharged along the top surfaces 139*a*, and is guided by the guide surface 142*a* of the auxiliary guide member 142 and conducted to the fixing nip 121 where it is fed through the fixing nip 121. At this time, the recording paper is fed while maintaining an orientation that is nearly the same as the straight line L connecting the exit opening of the transport nip 47 and the entrance opening of the fixing nip 121. The distance between the recording paper and the conductive member 131 is nearly constant in each location, and the potential difference between the recording paper and the conductive member 131 is thus made constant in each location.

The recording paper that has passed through the fixing unit 100 is fed upwards at a diagonal by the fixing unit 100, and the recording paper that has been sent to the paper exit path 50 undergoes a reversal in direction of paper travel by the internal guide member 51 and external guide member 62. The paper then exits onto the paper exit tray 52 via a paper exit roller pair 53, 55.

Although the paper exit path 50 is curved so that the recording paper is reversed, the radius of curvature of the paper exit path 50 can be large because the straight line L that connects the exit opening of the transfer nip 47 and the entrance opening of the fixing nip 121 is higher towards the fixing nip 121.

The invention claimed is:

1. An image forming device for forming images on a recording medium comprising:

a transfer unit including a photosensitive drum and a transfer roller, wherein when a recording medium is held at a transfer nip, the transfer roller is configured to impinge upon said photosensitive drum and transfer a developer image on said photosensitive drum onto said recording medium;

a fixing unit including a press roller and a heating roller, wherein when said recording medium is held at a fixing nip, the press roller is configured to impinge upon the heating roller to fix the developer image on said recording medium; and a guide member provided between said transfer unit and said fixing unit, said guide member configured to guide said recording medium into said fixing unit along a transport path, wherein said guide member includes a grounded conductive member and ribs, the ribs configured to control contact of said recording medium with said conductive member by protruding towards the transport path, and wherein said conductive member and said ribs are formed parallel with a line that connects said transfer nip and said fixing nip.

2. The image forming device according to claim 1, further comprising an auxiliary guide member provided between said guide member and said fixing nip, configured to guide a front edge of said recording medium into the fixing nip of said fixing unit.

3. The image forming device according to claim 2, wherein an end of said auxiliary guide member that is closest to said guide member is provided at a location that is farther from said recording medium than an end of said guide member that is closest to said auxiliary guide member when said recording medium is in contact with both said auxillary guide member and said guide member.

4. The image forming device according to claim 2, wherein said auxiliary guide member is positioned at a greater incline than said guide member relative to a transport direction of said recording medium.

5. The image forming device according to claim 3, wherein said auxiliary guide member is positioned at a greater incline than said guide member relative to a transport direction of said recording medium.

6. The image forming device according claim 1, wherein said transfer unit is configured to transport said recording medium at a transport rate equivalent to a transport rate that said fixing unit is configured to transport said recording medium.

7. The image forming device according to claim 1, wherein a transport direction of said recording medium from said transfer unit intersects said guide member.

8. The image forming device according to claim 1, wherein the fixing nip and the transfer nip are cooperatively configured to hold the recording medium therebetween and maintain the recording medium at a position wherein a distance between the recording medium and the conductive member is uniform.

* * * * *